United States Patent [19]

Lee

[11] Patent Number: 4,936,574

[45] Date of Patent: Jun. 26, 1990

[54] FISHING FISH TOY

[76] Inventor: Ching H. Lee, 14, Shin Ping Rd., Tainan, Taiwan

[21] Appl. No.: 247,486

[22] Filed: Sep. 21, 1988

[51] Int. Cl.[5] ..... A63F 9/00

[52] U.S. Cl. ..... 273/1 GG

[58] Field of Search ..... 273/1 GG, 140, 237; 446/368

[56] References Cited

U.S. PATENT DOCUMENTS

| | | | |
|---|---|---|---|
| 626,995 | 6/1899 | Haigh | 273/140 |
| 2,703,469 | 3/1955 | Raizen | 273/1 GG X |
| 2,933,315 | 4/1960 | Carr, Jr. | 273/140 X |
| 4,224,761 | 9/1980 | Wakimura | 273/237 |
| 4,813,670 | 3/1989 | Mizunuma | 446/368 X |

*Primary Examiner*—Paul E. Shapiro

*Attorney, Agent, or Firm*—Fleit, Jacobson, Cohn, Price, Holman & Stern

[57] ABSTRACT

A fishing fish toy comprising a rotatable upper plate having holes for placing toy fish which can be pushed to climb up and down protruding rails set on a stationary lower plate as the upper plate is turned. As the toy fish is climbing up the rail, it can open its mouth for a hook to hook at its lip and as the toy fish is descending the rail it shuts its mouth so that the fish can be pulled up with the hook being caught in the mouth.

5 Claims, 5 Drawing Sheets

FISHING FISH TOY

BACKGROUND OF THE INVENTION

The American patent application of the Ser. No. 07/1,029,814 titled "Fishing-crab toys" filed by the same applicant of the present invention comprises toy crabs with claws possible to close and open for being hooked up with a hook fastened on the string of a fishing rod. Another American patent application of the Ser. No. 4,749,195 titled "Fishing-octopus toys" also filed by the same applicant comprises toy octopuses whose heads can be enveloped and fished up by a cage bound with a string of a fishing rod. These two kinds of toys have different ways in playing them, and so does another American patent application of the Ser. No. 4,224,761, wherein a round biat is to be placed in the mouth of a toy fish in playng and the string can be caught in an aperture between the teeth of the toy fish for pulling up the toy fish straight upward. So the rising-up movement of the toy fish is different from the practical movement of real fish, short of realistic fishing thrill which can be acquired in practical fishing.

SUMMARY OF THE INVENTION

This invention has been devised to give a kind of fishing way very similar to that a real fish swallows a bait.

This fishing toy comprises a conventional rotatable upper plate provided with a plurality of holes arranged for receiving toy fish and each hole has a curved aperture at the bottom for curved protruding rails set irregularly on a stationary lower plate to pass through when the upper plate is turned around. Each of the rails is provided with an upwardly inclined leading slope surface, a generally horizontal flat high surface and a downwardly inclined trailing slope surface.

Each fish toy consists of a body and a head combined together by two shafts extending sideward on the body and two shaft holes in the head, so the head can turns backward or forward with the shafts as pivots as if the fish opens or shuts its mouth.

While the upper plate is turning around and a toy fish is climbing the upwardly inclined leading slope surface of the rail, a fish head turns backward to let its mouth open, while the toy fish is sliding on the flat high surface the fish mouth stays open, and while the toy fish is descending the downwardly inclined trailing slope surface the fish head turns forward to close its mouth.

A hook with three claws can be managed to put under the lip of the fish head during the mouth opening and to be pulled up during the fish mouth closing in playing this toy.

BRIEF DESCRIPTION OF THE DRAWINGS

This invention will now be described in detail with reference to accompanying drawings wherein.

DETAILED DESCRIPTION OF THE INVENTION

Figure 1:
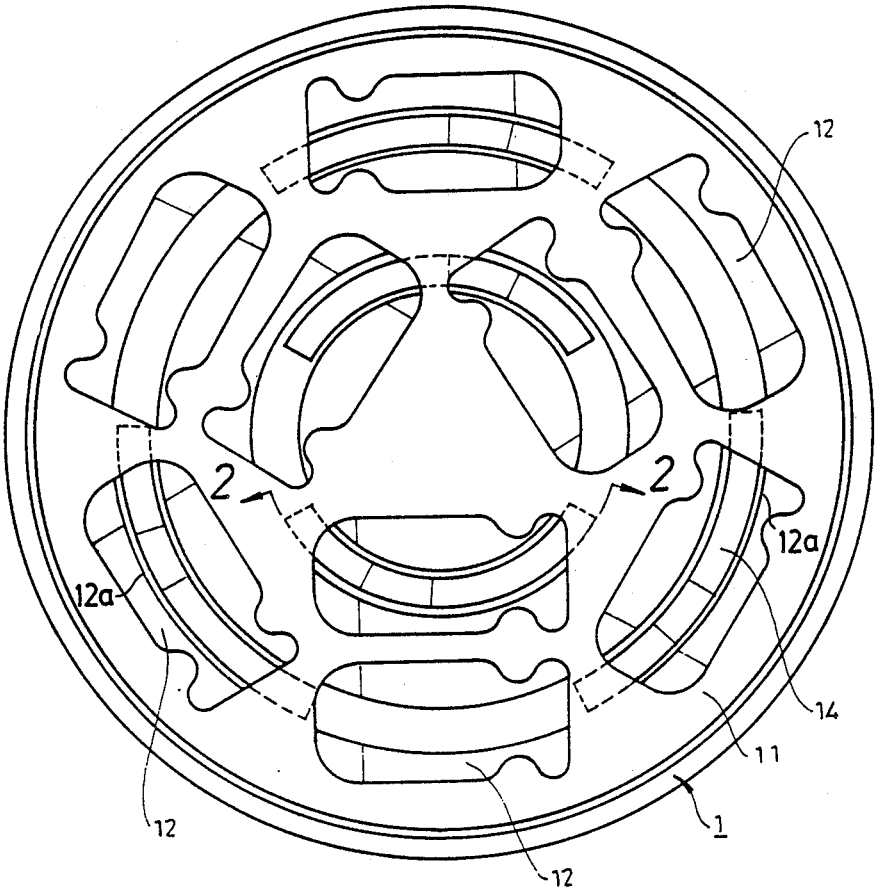
FIG. 1 is a top plan view of the rotatable upper plate in accordance with the present invention.
Figure 2:
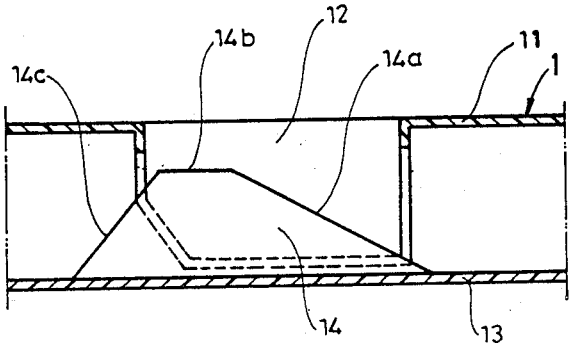
FIG. 2 is a cross-sectional view taken along line 2—2 of FIG. 1.

The fishing toy 1 as shown in FIGS. 1 and 2 includes a traditional rotatable upper plate 11 provided with hole 12 for receiving toy fish 2, a stationary lower plate 13 having protruding rails 14 fixed thereon and a motion transmitting means not drawn in the Figures. The rotatable upper plate 11 is turned by the motion transmitting means. The holes 12 for receiving toy fish are different from those in conventional fishing toys so as to conform the shape of fish, but are provided also with a curved apertures **12*a* for protruding rails 14 to pass through. The protruding rails 14 have a different shape from those in the applications of the Ser. Nos. 4,224,761, 07/1,029,814, and 4,749,195, including an upwardly inclined leading slope surface 14*a*, a flat high surface 14*b* and a downwardly inclined trailing slope surface 14*c* connected continuously so as to change the movement of the toy fish 2**.

Figure 3:
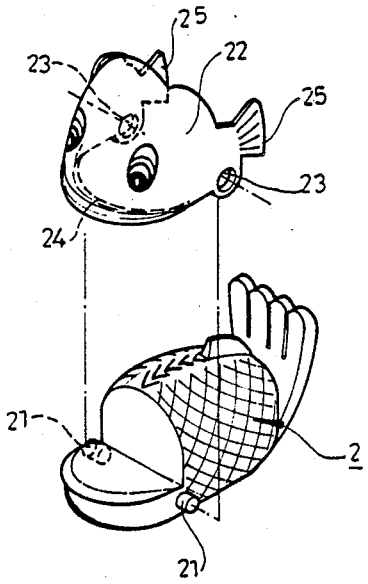
FIG. 3 is an exploded perspective view of the toy fish in accordance with the present invention.

The toy fish 2 shown in FIG. 3 is provided with a body **2*b* having a flat bottom 2*c* to engage the protruding rail, and two protruding outward shafts 21 for combining with two shaft holes 23 in a fish head 22, and whereby the fish body 2*b* is assembled with the fish head 22. The head 22 is also provided with an inward protruding lip 24 and a pair of fins 25** at both sides.

Figure 4:
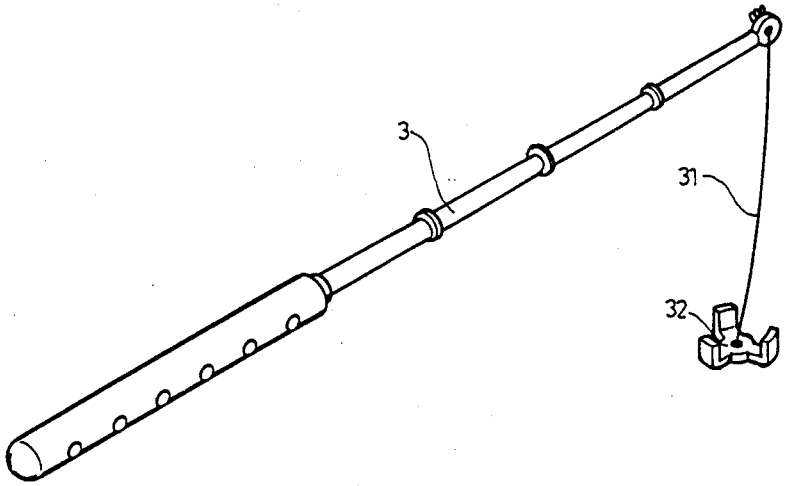
FIG. 4 is a perspective view of the fishing rod in accordance with the present invention.

The fishing rod 3 shown in FIG. 4 is fastened with a string 31 and the bottom end of the string 31 is fixed with a three-claw hook 32 used for hooking the lip 24 of the toy fish 2 in fishing action.

Figure 5:
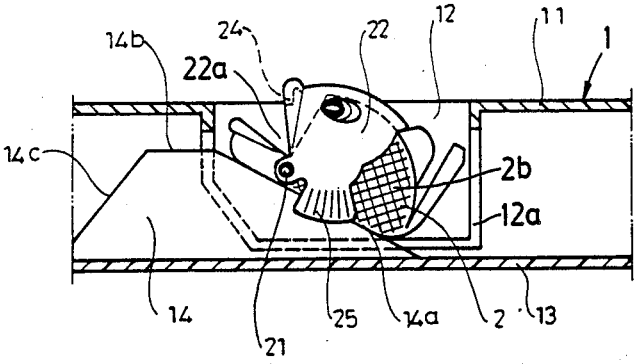
FIG. 5 is a fragmentary sectional view of the toy with a fish riding on the upwardly inclined leading slope surface of the protruding rail in a hole in accordance with the present invention.
Figure 6:
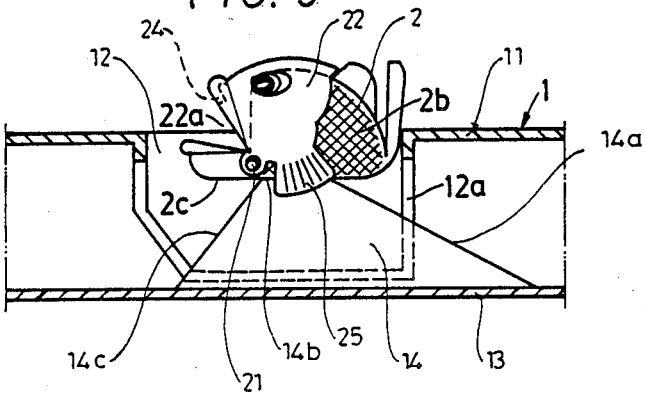
FIG. 6 is a fragmentary sectional view of the toy with a fish riding on the flat high surface of the protruding rail in a hole in accordance with the present invention.
Figure 7:
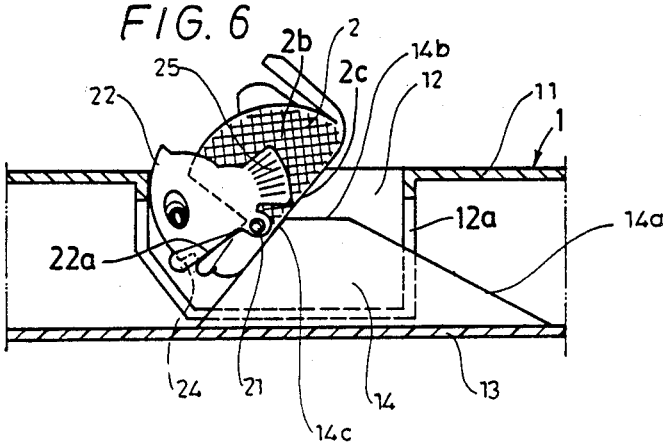
FIG. 7 is a fragmentary section view of the toy fish riding on the downwardly inclined trailing slope surface of the protruding rail in a hole in accordance with the present invention.

Next, referring to FIG. 5, as the upper plate 11 turns around, the fish 2 placed in the hole 12 at first rides the upwardly inclined slope surface **14*a* of the rail 14, tilting its head 22 backward, and the center of gravity of the fish head 22 comes behind the vertical line from the shafts 21 to the ground, so the head 22 inclines backward as though a fish floated up breathing in air with its mouth 22*a* open. Meanwhile, the fish 2 continues to move up and goes to ride the flat high surface 14*b* as shown in FIG. 6, and the center of gravity of the fish head 22 is still at the same point mentioned above and its mouth is kept on open. But as the toy fish moves on to slide down the downwardly inclined slope surface 14*c*, the fish 2 inclines forward, its head 22 quickly turning forward with the shafts 21** as pivots as though a fish shut up its mouth making diving movement, because the center of gravity of the fish 2 moves to the front of the vertical line from the shafts 21 to the ground. Thus, the three different movements the fish 2 makes in passing on the rail 14 can give the player an impression of a real fish in motion.

Figure 8:
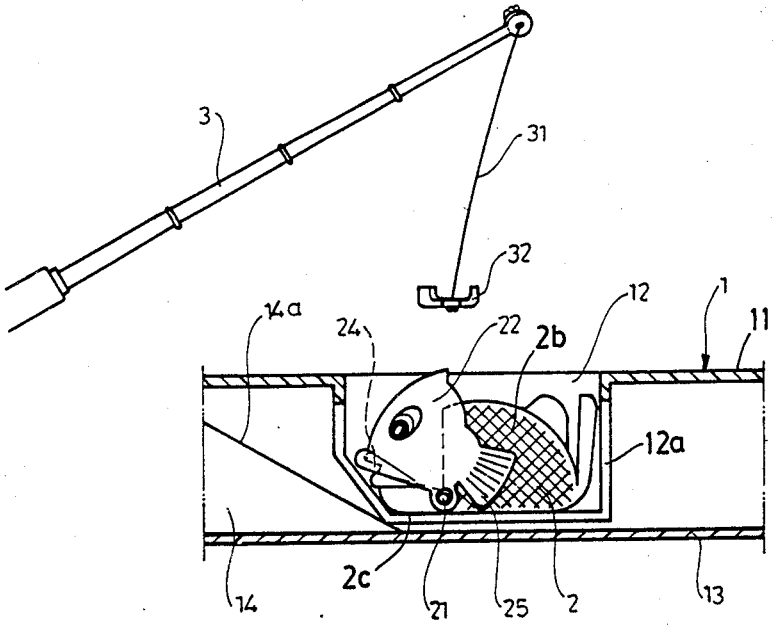
FIG. 8 is a fragmentary sectional view of the top illustrating the first actional view of fishing this toy in accordance with the present invention.

Next, referring to FIG. 8, when the fish 2 sinks down in the hole 12, the head 22 covers the body so that the hook 32 cannot be made to hook the lip 24, since the fins 25 touch the bottom of the hole 12 forcing the head 22 to tilt forward.

While the fish 2 is climbing up the upwardly inclined slope surface 14*a* with its head 22 tilting backward and its lip 24 being almost vertical to the ground, the hook 32 can be made to insert between the head 22 and the body so as to hook the lip 24.

Figure 9:
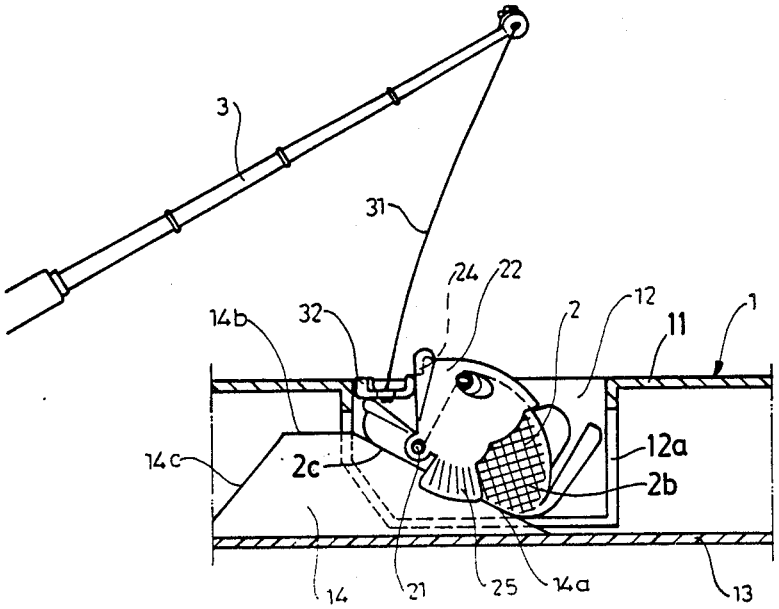
FIG. 9 is a fragmentary sectional view illustrating the second actional view of fishing this toy in accordance with the present invention.
Figure 10:
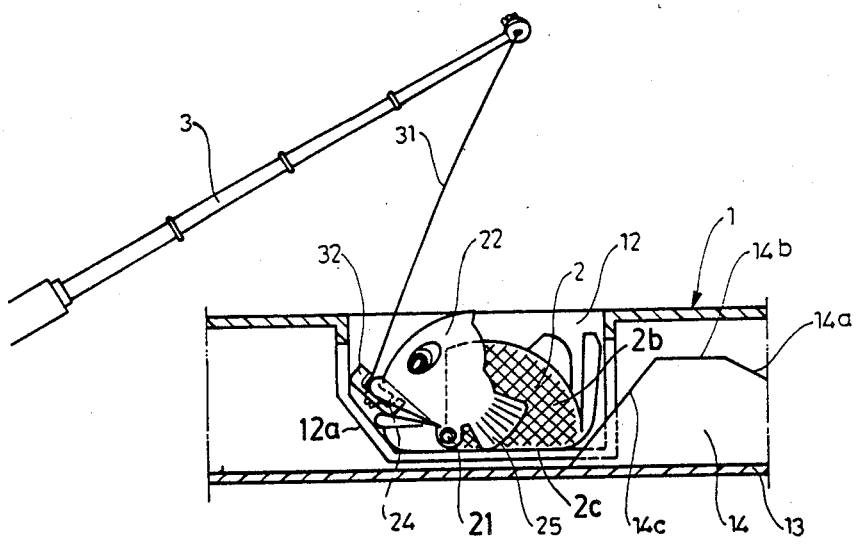
FIG. 10 is a fragmentary sectional view illustrating the third actional view of fishing this toy in accordance with the present invention.
Figure 11:
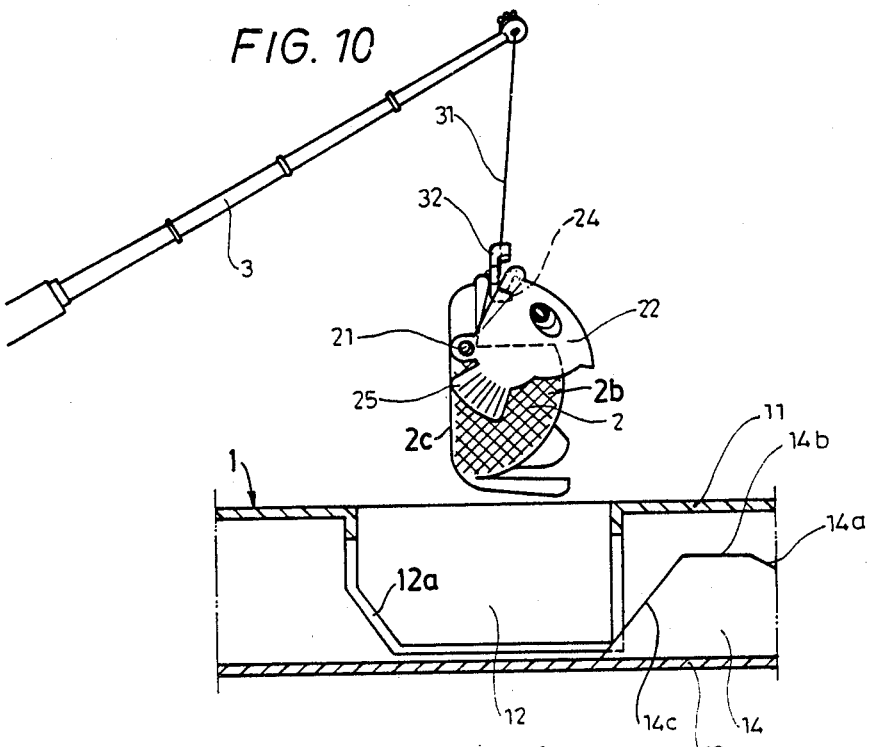
FIG. 11 is a fragmentary sectional view illustrating the fourth actional view of fishing this toy in accordance with the present invention.

When the fish 2 gradually moves from the position shown in FIG. 9 to the position shown in FIG. 10 and the head 22 turns forward to close its mouth, the hook 32 is still kept caught in the mouth so that the fish 2 can be pulled up by the rod 3 as shown in FIG. 11.

In general, the fishing method and the movement of the toy fish to be fished up enable the player to imagine as though he was fishing a real fish, so this toy is unprecedented.

What is claimed is:

1. A fishing toy including an upper plate having at least one upwardly opening recess therein with an aperture formed therethrough, a toy fish having a body including front and rear ends and a a base surface as well as a head, the head and body defining a mouth of the toy fish therebetween, pivot means pivotally mounting said head on the body for oscillation about a horizontal transverse axis relative to said body between mouth-open and mouth-closed positions relative thereto, the configuration of the head and body as well as the location of said axis relative to said head and body being such that when the base surface is substantially horizontally oriented the head may be urged by gravity to mouth-open and mouth-closed positions on either side of and from a central position thereof responsive to said base surface being forwardly and upwardly inclined and forwardly and downwardly inclined, respectively, said recess being configured for receiving the toy fish therein with said base surface substantially horizontally oriented, said toy further including a lower plate from which the upper plate is supported for relative movement of the plates, said lower plate having an upwardly protruding rail configured for movement along said aperture upon relative movement of the plates, the rail having an upwardly inclined leading surface for engaging said base surface and tilting the body of the toy fish forwardly and upwardly as the rail is moved along the aperture for moving the center of gravity of the head relative to the body rearwardly of said axis so as to gravity pivot the head to a mouth-open position, the rail having a downwardly inclined trailing surface for engaging said base surface and tilting the body of the toy fish forwardly and downwardly as the rail is moved further along said aperture for moving the center of gravity of the head forwardly of said axis so as to gravity return the head to the mouth-closed position, said tilting movement of the toy fish simulating a fish in motion.

2. The invention defined in claim 1 wherein said plates are mounted for relative rotation and wherein said rail and aperture are substantially arcuate in plan view.

3. The invention defined in claim 1 wherein said rail has a substantially horizontal intermediate edge connecting said leading and trailing edges and said head, while in said mouth-open position, remains therein while said fish body moves along said flat high surface.

4. The invention defined in claim 1 wherein the toy includes a rod, a line, and a hook for receipt in the mouth of the toy fish when the head is in said mouth-open position, and for being trapped therein when the head returns to the mouth-closed position.

5. A fishing toy including first and second members mounted for relative horizontal movement, a toy fish having a body including front and rear ends and a head, said head and body defining a mouth of the toy fish therebetween, pivot means pivotally mounting said head on said body for oscillation about a horizontal transverse axis relative to said body between mouth-open and mouth-closed positions relative thereto, said first member defining recess means loosely receiving said toy fish therein for up and down shifting movement relative to said first member and against excessive horizontal shifting relative thereto, said second member including fish body supporting means thereon from which said fish body is supported during at least a portion of relative horizontal movement of said members, said fish body and second member including co-acting means operative, during said portion of relative horizontal movement of said first and second members, to successively forwardly and upwardly incline and elevate said fish body from a low horizontal position in said recess means to a high position in said recess means, forwardly tilt said fish body while in said high position to a generally horizontal position and then further forwardly tilt said fish body to a forwardly and downwardly inclined position, lower said fish body back to said low position and rearwardly tilt said body back to a horizontal position, the configuration of said head and body as well as the location of said axis relative to said head and body being such that when said body is substantially horizontally oriented the head may be urged by gravity to mouth-open and mouth-closed positions on either side of a central position thereof responsive to said body being tilted to said forwardly and upwardly inclined and forwardly and downwardly inclined positions, respectively.

* * * * *